US010888765B2

(12) United States Patent
Duke

(10) Patent No.: US 10,888,765 B2
(45) Date of Patent: Jan. 12, 2021

(54) BOWLING BALL RAMP INCLUDING EMBEDDED LIGHTING AND/OR SOUND

(71) Applicant: Bradley N. Duke, Lincolnton, NC (US)

(72) Inventor: Bradley N. Duke, Lincolnton, NC (US)

( * ) Notice: Subject to any disclaimer, the term of this patent is extended or adjusted under 35 U.S.C. 154(b) by 0 days.

(21) Appl. No.: 16/573,396

(22) Filed: Sep. 17, 2019

(65) Prior Publication Data

US 2020/0086198 A1 Mar. 19, 2020

Related U.S. Application Data

(60) Provisional application No. 62/733,560, filed on Sep. 19, 2018.

(51) Int. Cl.

| | |
|---|---|
| ***A63D 5/00*** | (2006.01) |
| ***A63B 71/06*** | (2006.01) |
| ***A63B 71/00*** | (2006.01) |

(52) U.S. Cl.

CPC ..... *A63B 71/0622* (2013.01); *A63B 71/0009* (2013.01); *A63D 5/00* (2013.01); *A63B 2071/0625* (2013.01); *A63B 2208/12* (2013.01); *A63B 2225/74* (2020.08)

(58) Field of Classification Search

CPC ... A63B 71/0009; A63B 5/00; A63B 71/0622; A63B 2225/74; A63B 2071/0625; A63B 2208/12

USPC ..... 273/120 R, 120 A, 129 Q; 473/55, 56

See application file for complete search history.

(56) References Cited

U.S. PATENT DOCUMENTS

| | | | | |
|---|---|---|---|---|
| 3,083,967 A * | 4/1963 | Steel | A63B 71/0009 473/59 |
| 3,159,401 A * | 12/1964 | Ikenberry | A63B 71/0009 473/56 |
| 3,539,183 A * | 11/1970 | Lieb | A63B 71/0009 473/56 |
| 3,888,483 A * | 6/1975 | Adickes | A63D 3/00 473/107 |
| 4,180,267 A * | 12/1979 | Harrop | A63F 7/3065 273/118 A |

(Continued)

OTHER PUBLICATIONS

Youtube, Flash Bowling Ball Ramp, by Bradley Duke, https://www.youtube.com/watch?v=m7VJAirRlVw , Oct. 2018.*

(Continued)

*Primary Examiner* — William M Pierce

(74) *Attorney, Agent, or Firm* — Christopher C. Dremann, P.C.; Christopher C. Dremann

(57) ABSTRACT

A bowling ball ramp includes a substantially transparent, generally hollow, tubular stand assembly, a substantially transparent, generally hollow, tubular ramp assembly structurally coupled to the stand assembly, and lighting embedded within at least one of the stand assembly and the ramp assembly. A detection sensor is provided for detecting a bowling ball on the ramp assembly. Electronics activate the lighting to illuminate the stand assembly and/or the ramp assembly in response to the detection sensor detecting the bowling ball on the ramp assembly. The electronics may also activate an audio speaker to produce an audible sound in response to the detection sensor detecting the bowling ball on the ramp assembly. The embedded lighting and/or the audible sound enhance the enjoyment of a bowling experience for a child or handicapped individual using the bowling ball ramp.

13 Claims, 7 Drawing Sheets

(56) References Cited

U.S. PATENT DOCUMENTS

| | | | | | |
|---|---|---|---|---|---|
| 5,255,185 | A * | 10/1993 | Mowers | A63D 1/00 | 340/323 R |
| 5,556,106 | A * | 9/1996 | Jurcisin | A63B 47/002 | 273/395 |
| 5,846,138 | A * | 12/1998 | Borden | A63D 1/00 | 473/54 |
| 6,031,343 | A * | 2/2000 | Recknagel | A63D 1/08 | 315/292 |
| 6,042,482 | A * | 3/2000 | Wilds | A63D 5/00 | 273/120 R |
| 6,280,344 | B1 * | 8/2001 | Robb | A63B 37/0001 | 473/125 |
| 2004/0220001 | A1 * | 11/2004 | Oister | A63B 67/197 | 473/570 |
| 2007/0209543 | A1 * | 9/2007 | Beaulieu | A63F 7/3622 | 104/53 |
| 2007/0283612 | A1 * | 12/2007 | Shaw | A01K 87/007 | 43/17 |
| 2012/0248332 | A1 * | 10/2012 | Kreitenberg | A61L 2/10 | 250/455.11 |
| 2014/0200088 | A1 * | 7/2014 | Vaioli | A63D 1/00 | 473/70 |
| 2018/0369672 | A1 * | 12/2018 | Wheeler | A63B 1/00 | |
| 2019/0321714 | A1 * | 10/2019 | Duell | A63D 5/02 | |

OTHER PUBLICATIONS

Youtube, Flash Bowling Ball Ramp 2, by Bradley Duke, https://www.youtube.com/watch?v=DRQqqliDVvw , Jun. 2019.*

* cited by examiner

BOWLING BALL RAMP INCLUDING EMBEDDED LIGHTING AND/OR SOUND

FIELD OF THE INVENTION

The present invention relates generally to apparatus, devices and methods for facilitating and enhancing the enjoyment of sports, games and entertainment. More particularly, the invention is a bowling ball ramp including illumination and/or sound, and a method for providing a bowling ball ramp with illumination and/or sound.

BACKGROUND OF THE INVENTION

A bowling lane, or alley, may be equipped with side rails that prevent an improperly aimed bowling ball from entering into a side gutter, and thus, not striking any of the bowling pins. However, the side rails eliminate an element of skill and introduce an element of luck into the game of bowling. Consequently, the use of side rails can be damaging to self-esteem, particularly in children and handicapped individuals. Bowling ball ramps are known for providing children and handicapped individuals with the opportunity to participate in bowling without sacrificing self-esteem. In particular, a bowling ball ramp allows a child or handicapped individual to more accurately aim and launch a bowling ball down the bowling lane towards the bowling pins. The bowling ball ramp provides an elevated starting position for the bowling ball and cradles the ball along an angled, descending ramp so that the ball is delivered to the surface of the bowling lane in a desired direction of travel and with sufficient velocity to reach the bowling pins at the end of the lane. The child or handicapped individual is responsible for launching the bowling ball and is merely assisted in supporting the ball in a starting position and aiming the ball in a desired direction down the lane towards the pins.

Most individuals participate in bowling as a form of entertainment. For that reason, many bowling alleys provide sound, for example music, and/or illumination, for example flashing and/or colored lighting, to enhance the entertainment experience. Bowling ball ramps have enjoyed much success in facilitating and enhancing the enjoyment of bowling, especially for children and handicapped individuals that are challenged to aim and launch a bowling ball in a desired direction down a bowling lane towards the bowling pins. However, the existing bowling ramps are typically metal structures that lack aesthetics or additional functionality that enhance enjoyment of the bowling experience for children and handicapped individuals.

It is therefore apparent that a need exists for a bowling ball ramp that both facilitates and enhances enjoyment of bowling for children and handicapped individuals. A more particular need exists for a bowling ball ramp that includes additional functionality to enhance the entertainment experience of bowling. A specific need exists for a bowling ball ramp that provides illumination and/or sound to enhance the enjoyment and the entertainment experience of bowling. In a particular exemplary embodiment, a bowling ball ramp includes electronics operable for providing illumination and/or sound, and a method for providing a bowling bowl ramp with illumination and/or sound.

Certain aspects, objects, features and advantages of the present invention will be made apparent, or will be readily understood and appreciated by those skilled in the relevant art, as exemplary embodiments of the invention shown in the accompanying drawing figures are described in greater detail. It is intended that all such aspects, objects, features and advantages of the invention envisioned by this disclosure of exemplary embodiments are encompassed by the scope of the appended claims, given their broadest reasonable interpretation and the broadest reasonable construction of their claim terms. These aspects, objects, features and advantages of the invention, as well as others not expressly disclosed, may be accomplished by any of the exemplary embodiments described herein and illustrated in the accompanying drawings. However, it should be appreciated that the drawing figures are for illustrative purposes only, and that many modifications, changes, revisions and substitutions may be made to any of the exemplary embodiments without departing from the intended broadest reasonable interpretation of the general concepts of the invention and the broadest reasonable construction of the claim terms.

BRIEF DESCRIPTION OF THE DRAWINGS

The aforementioned aspects, objects, features and advantages of the present invention will be more fully understood and appreciated when considered in conjunction with the accompanying drawing figures, in which like reference characters designate the same or similar parts throughout the several views.

DETAILED DESCRIPTION OF EXEMPLARY EMBODIMENTS OF THE INVENTION

Figure 1:
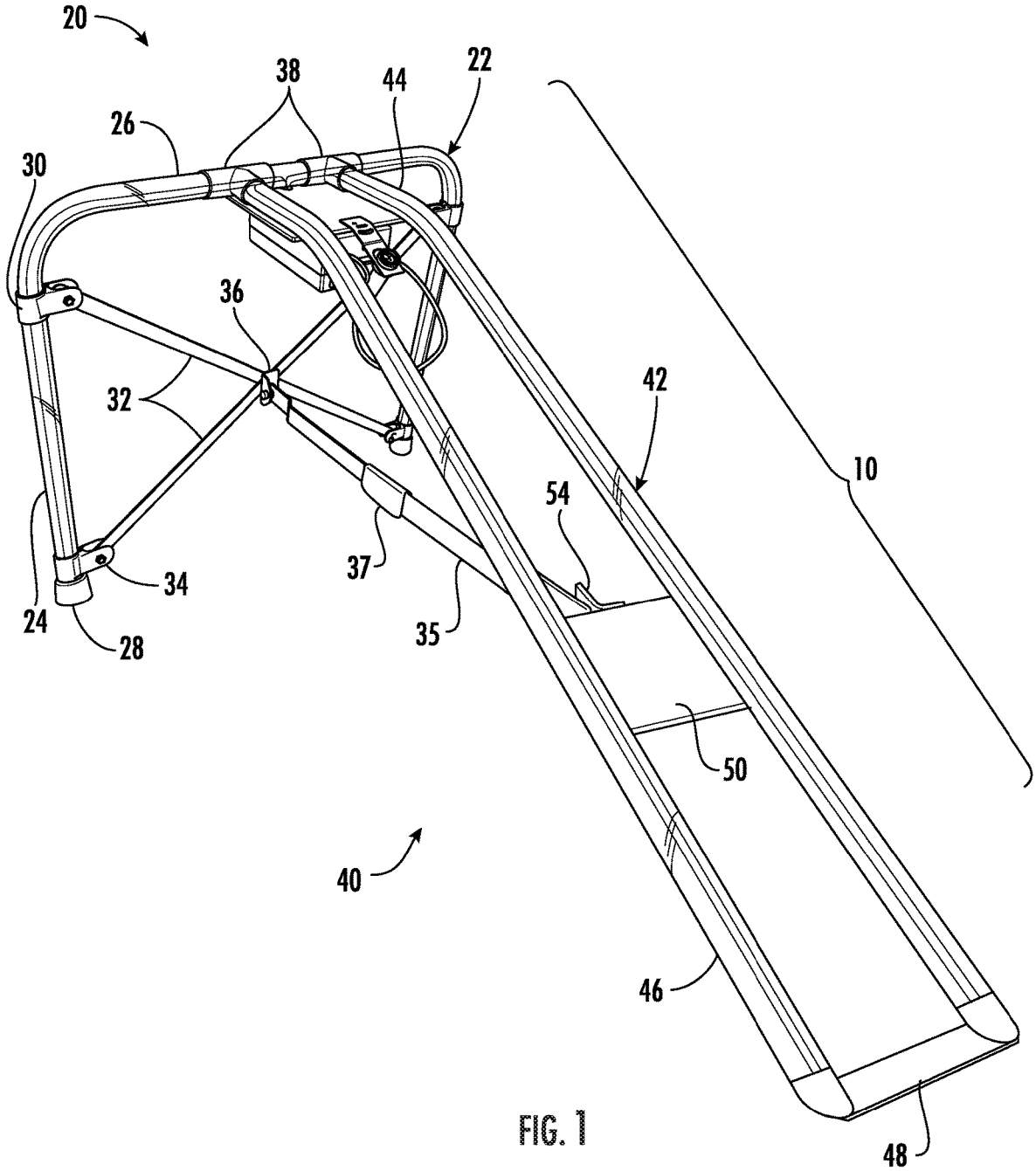
FIG. 1 is a front perspective view of a bowling ball ramp according to an exemplary embodiment of the present invention shown in a use configuration.

FIG. 1 shows a bowling ball ramp, indicated generally by reference character 10, according to an exemplary embodiment of the present invention. The bowling ball ramp 10 is useful for assisting a child or handicapped individual to launch a bowling ball in a desired direction down a bowling lane in the direction of bowling pins at the end of the bowling lane. Specifically, the bowling ball ramp facilitates enjoyment of the bowling experience by allowing a child or handicapped individual to position a bowling ball in an elevated starting position and to aim the bowling ball down the bowling lane at the bowling pins. The bowling ball ramp 10 comprises a stand assembly, indicated generally by reference character 20 and a ramp assembly, indicated generally by reference character 40. The ramp assembly 40 is connected to the stand assembly 20, for example in the manner described hereinafter.

In the exemplary embodiment shown and described herein, the stand assembly 20 comprises a stand 22 for supporting the ramp assembly 40 in an upright, elevated configuration, as depicted in FIG. 1. The stand 22 may be generally U-shaped and made from a tubular material, such as molded plastic or metal, for example extruded aluminum. In a preferred embodiment, the stand 22 is made from substantially transparent, rigid polyvinylchloride (PVC) pipe of the type available from United States Plastic Corporation of Lima, Ohio, USA. The PVC pipe is relatively thin-walled and generally hollow, yet sufficiently rigid to support at least the ramp assembly 40 and a bowling ball in the use configuration shown in FIG. 1. By way of example and not limitation, the PVC pipe may be 2 inch SCH40 transparent PVC pipe having an inner diameter (ID) of about 2.047 inches and an outer diameter (OD) of about 2.375 inches with a wall thickness of about 0.154 inches. The PVC pipe may be formed by bending into the generally U-shaped stand 22 defining a pair of vertically extending legs 24 interconnected by a horizontally extending crossbar 26. The free end of each of the legs 24 may be provided with an endcap 28 made of a relatively elastic material, such as soft rubber or soft plastic, suitable for protecting the surface of a bowling lane. The endcap 28 may be secured to the end of a respective leg 22 in any suitable manner, such as by gluing or fusing.

The stand 22 further comprises attachment brackets 30 configured for receiving the opposed ends of at least one cross member 32 that extends between the legs 24 of the stand. Each attachment bracket 30 may be secured to a respective leg 24 in any suitable manner, for example by gluing or fusing. As shown and described herein, the stand 22 has a pair of cross members 32 with each opposed end of each cross member 32 being attached to a respective leg 24 of the stand 22 by a respective attachment bracket 30. The opposed ends of the cross members 32 may be rigidly secured to the attachment bracket 30, or alternatively, may be rotatably attached to the attachment bracket 30, as shown. The opposed ends of the cross members 32 may be rotatably, or "hingedly," attached to the attachment bracket 30 in any suitable manner, for example by a hinge pin 34. In the embodiment shown and described herein, each cross member 32 extends between an upper end of one leg 24 to the lower end of the other leg 24 of the stand 22. However, one or more cross members 32 may extend between the legs 24 of the stand 22 in any suitable manner that provides sufficient structural strength to support for the ramp assembly 40 and a bowling ball on the bowling ball ramp 10.

As shown, the cross members 32 of the stand 22 are interconnected and secured together by a cross member bracket 36, for a purpose to be described hereinafter. The stand 22 further comprises one or more couplers 38 for receiving the ramp assembly 40, as will be described hereinafter. Specifically, the stand 22 comprises at least one coupler 38 disposed medially on the horizontally extending crossbar 26 between the vertically extending legs 24. As shown, the stand 22 comprises a pair of tubular couplers 38 disposed medially on the crossbar 26 and rotatably mounted thereon. Each of the couplers 38 defines a tubular opening for receiving the ramp assembly 40 in a manner to be described hereinafter.

In the exemplary embodiment shown and described herein, the ramp assembly 40 comprises a pair of generally parallel ramp arms 42 having an upper end secured to the coupler(s) 38 of the stand 22 of the stand assembly 20. The ramp arms 42 descend from the horizontally extending crossbar 26 of the stand 22 angularly to a lower end of the ramp arms 42 adjacent to the surface of the bowling lane (not shown). The ramp arms 42 comprise a pair of horizontally extending ball supports 44 for supporting a bowling ball at an elevated position relative to the surface of the bowling lane and a pair of angularly extending ball supports 46 for supporting the bowling ball on the ramp assembly 40 as the bowling ball descends from the ball supports 44 to the surface of the bowling lane. The ramp arms 42 are made from a substantially transparent tubular material, such as molded plastic. In a preferred embodiment, the ramp arms 42 are made from substantially transparent, rigid polyvinylchloride (PVC) pipe of the type available from United States Plastic Corporation of Lima, Ohio, USA. The PVC pipe is relatively thin-walled and generally hollow, yet sufficiently rigid to support at least a bowling ball in the use configuration shown in FIG. 1. By way of example and not limitation, the PVC pipe may be 2 inch SCH40 transparent PVC pipe having an inner diameter (ID) of about 2.047 inches and an outer diameter (OD) of about 2.375 inches with a wall thickness of about 0.154 inches. The PVC pipe may be formed by bending the ramp arms 42 defining the horizontally extending ball supports 44 and the angularly extending ball supports 46.

If desired, the lower end of the ramp arms 42 may terminate in an optional distal crossbar 48 for providing additional support on the surface of the bowling lane and for preventing the pair of angularly extending ball supports 46 from separating relative to one another. As shown, the bowling ramp assembly 40 also comprises at least one medial crossbar 50 for providing additional support to the angularly extending ball supports 46 and for preventing the ball supports 46 from separating relative to one another. In addition, the bowling ramp assembly 40 may further comprise an optional proximal crossbar 52 for providing additional support to the horizontally extending ball supports 44 and for preventing the ball supports 44 from separating relative to one another. The proximal crossbar 52 may further support an electronics assembly, indicated generally by reference character 60, as will be described hereinafter. Regardless, the upper end of the ramp arms 42, and in particular the free ends of the horizontally extending ball supports 44, are secured to the coupler(s) 38 on the crossbar 26 of the stand 22 of the stand assembly 20. The ramp arms 42 are received within the respective openings of the coupler (s) 38 and secured thereto in any suitable manner, for example by gluing, fusing, welding or brazing. The generally parallel ramp arms 42 are spaced apart a suitable distance to support a bowling ball on the ramp assembly 40, while still permitting the bowling ball to roll along the ramp arms 42 from the horizontal ball supports 44 and down the angular ball supports 46 to the surface of the bowling lane.

Figure 2:
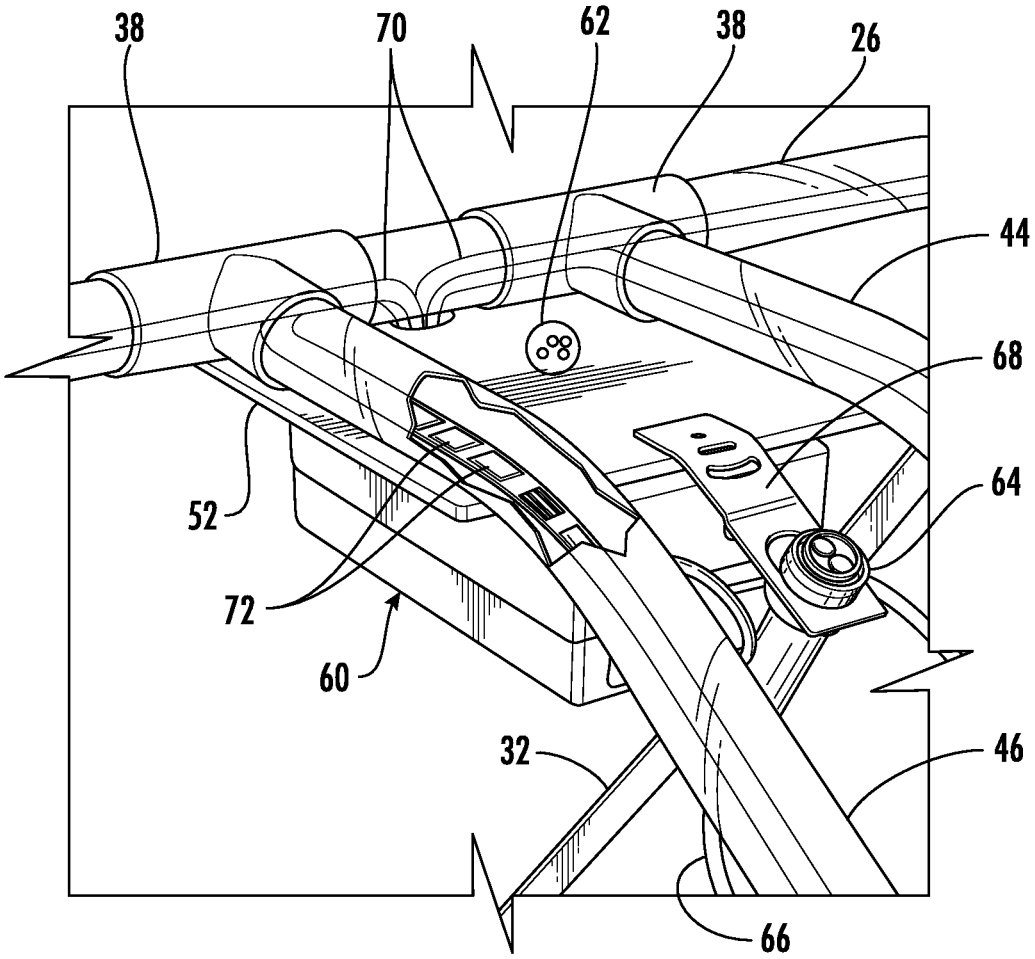
FIG. 2 is a detail perspective view showing an upper portion of the bowling ball ramp of FIG. 1 including an electronics assembly according to the present invention.

FIG. 2 shows the upper end of the ramp arms 42 of the ramp assembly 40 secured to the coupler(s) 38 and rotatably mounted on the crossbar 26 of the stand assembly 20 in greater detail. FIG. 2 also shows the electronics assembly 60 mounted on the ramp assembly 40 and operably coupled to the stand assembly 20 and the ramp assembly 40 to produce embedded lighting and/or sound in a manner to be described hereinafter. The electronics assembly 60 comprises a conventional printed circuit board having a microprocessor and additional electronics, such as a light emitter circuit and/or a sound emitter circuit electrically connected to an audio speaker 62. A detection sensor 64 is electrically connected to the microprocessor of the electronics assembly 60 and mounted between the ramp arms 42 of the ramp assembly 40. As shown herein, the detection sensor 64 is electrically connected to the electronics 60 by a cable 66 and is positioned between the generally parallel ramp arms 42 and secured to the proximal crossbar 52 of the ramp assembly 40 by a suitably configured extension bracket 68. However, the detection sensor 64 may communicate wirelessly with the electronics 60 and/or may be secured directly to the electronics 60. Regardless, the detection sensor 64 is operably coupled with the electronics 60, the ramp assembly 40 and the stand assembly 20, as will be described. The detection sensor 64 may be any type of sensor or transducer operable for detecting the presence or the movement of a bowling ball on the ramp arms 42 of the ramp assembly 40. By way of example and not limitation, the detection sensor 64 may be a light or optical sensor for detecting a change in illumination as a bowling ball passes the sensor, or a pressure sensor for detecting the force of a bowling ball against the sensor, or an electrical or magnetic signal transducer, such as a Hall effect sensor or a Reed switch sensor, for detecting a change in an electrical or magnetic field as a bowling ball passes the sensor.

In any event, the detection sensor 64 is operable for changing a state of the electronics 60, and in particular, for activating or deactivating the light emitter circuit and/or the sound emitter circuit of the electronics 60. As previously mentioned, the ramp arms 42 of the ramp assembly 40 are made of a substantially transparent, tubular, generally hollow, plastic material, such as transparent, rigid PVC pipe. The stand 22 (comprising legs 24 and crossbar 26) of the stand assembly 20 may likewise be made of a substantially transparent, tubular, generally hollow, plastic material, such as transparent, rigid PVC pipe. The bowling ball ramp 10 further comprises embedded lighting 70 disposed within at least the ramp arms 42 of the ramp assembly 40. As shown herein, the embedded lighting 70 is also disposed within the legs 24 and crossbar 26 of the stand 22 of the stand assembly 20. The embedded lighting 70 may comprise a string of light elements, such as a plurality of light-emitting-diodes (LEDs) 72 disposed within an LED rope light. In one embodiment, the embedded lighting 70 is an RGB (red/green/blue) Color Changing LED rope light of the type available from Birddog Lighting of Bozeman, Mont., USA. However, the embedded lighting may comprise any lighting that is suitable for being disposed within and visible through at least the substantially transparent ramps arms 42 of the ramp assembly 40.

Regardless, the embedded lighting 70 is electrically connected to the microprocessor of the electronics 60, and in particular, to the light emitter circuit of the electronics 60. As shown herein, the embedded lighting 70 extends outwardly from the electronics 60 and into the hollow crossbar 26 of the stand 22. The embedded lighting 70 next extends into the ramp arms 42 of the ramp assembly 40, and more particularly, into the hollow horizontal ball supports 44 and then down the hollow angled ball supports 46 towards the surface of the bowling lane. If desired, the embedded lighting 70 may comprise additional lengths of rope lights that extend outwardly from the electronics 60 through the horizontal crossbar 26 in opposite directions and then down the vertical legs 24 of the stand 22. The embedded lighting 70 may comprise solid or flashing lights, and/or single color or multi-color lights, in any desired combination. The embedded lighting 70 is activated or deactivated by the detection sensor 64 and the light emitter circuit of the electronics 60. By way of example and not limitation, the light emitter circuit of the electronics 60 may activate the embedded lighting 70 to illuminate when the detection sensor 64 detects either the presence or the passing of a bowling ball on the ramp arms 42 of the ramp assembly 40. The light emitter circuit of the electronics 60 may then deactivate the embedded lighting 70 to not illuminate after a predetermined period of time, for example, the amount of time that the bowling ball typically takes to travel along the ramp arms 42 of the ramp assembly 40 and down the bowling lane to the bowling pins.

If desired, the microprocessor of the electronics 60, and in particular, the sound emitter circuit and the audio speaker 62 of the electronics 60, may cause an audible sound to be emitted in conjunction with illumination of the embedded lighting 70. For example, the sound emitter circuit may cause an audible sound in the form of music, crowd noise, cheering and/or clapping to be emitted from the electronics 60 through the audio speaker 62 while the light emitter circuit causes the embedded lighting 70 to illuminate in response to an electrical signal received from the detection sensor 64 as a result of detecting either the presence or passing of a bowling ball on the ramp arms 42 of the ramp assembly 40. The illuminated lighting of the embedded lighting 70 and/or the audible sound enhance the enjoyment of the bowling experience for a child or handicapped individual using the bowling ball ramp 10, as well as other participants and observers.

Figure 3:
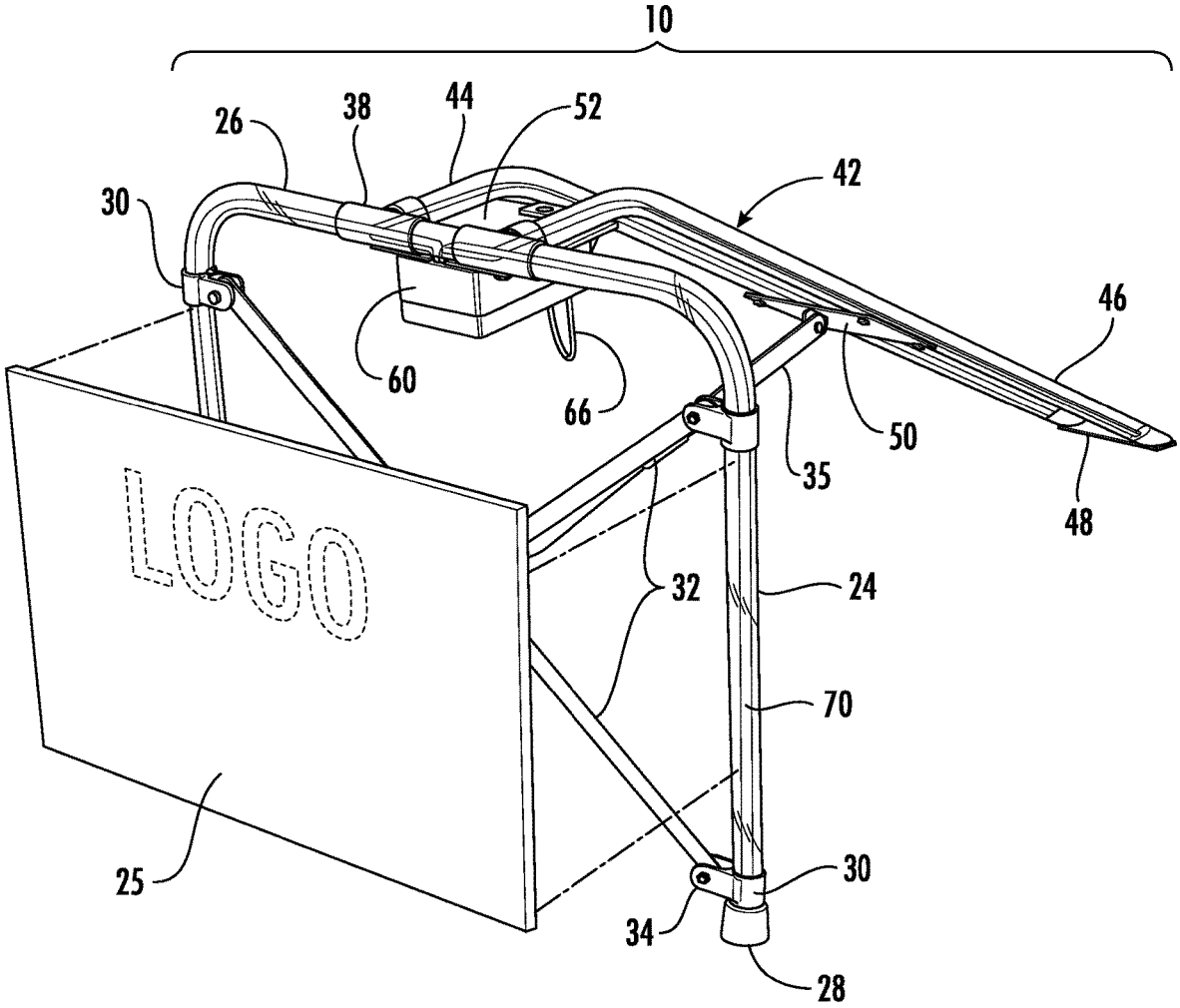
FIG. 3 is a rear perspective view showing an exemplary embodiment of the bowling ball ramp including printed indicia according to the present invention.

FIG. 3 is a rear perspective view illustrating optional printed indicia 25 that may be disposed on the stand assembly 20 of the bowling ball ramp 10 and displayed to an observer. In the embodiment shown herein, the printed indicia 25 comprises a logo, graphic, advertisement or the like, printed on a sufficiently rigid medium, such as paper, paperboard, cardboard or the like, that is attached to the vertically extending legs 24 of the stand 22 of the bowling ball ramp 10. Alternatively, the medium of the printed indicia 25 may be attached to one or both of the cross members 32 or to one or more of the attachment brackets 30 so as to not obstruct the visibility of the embedded lighting 70.

Figure 4:
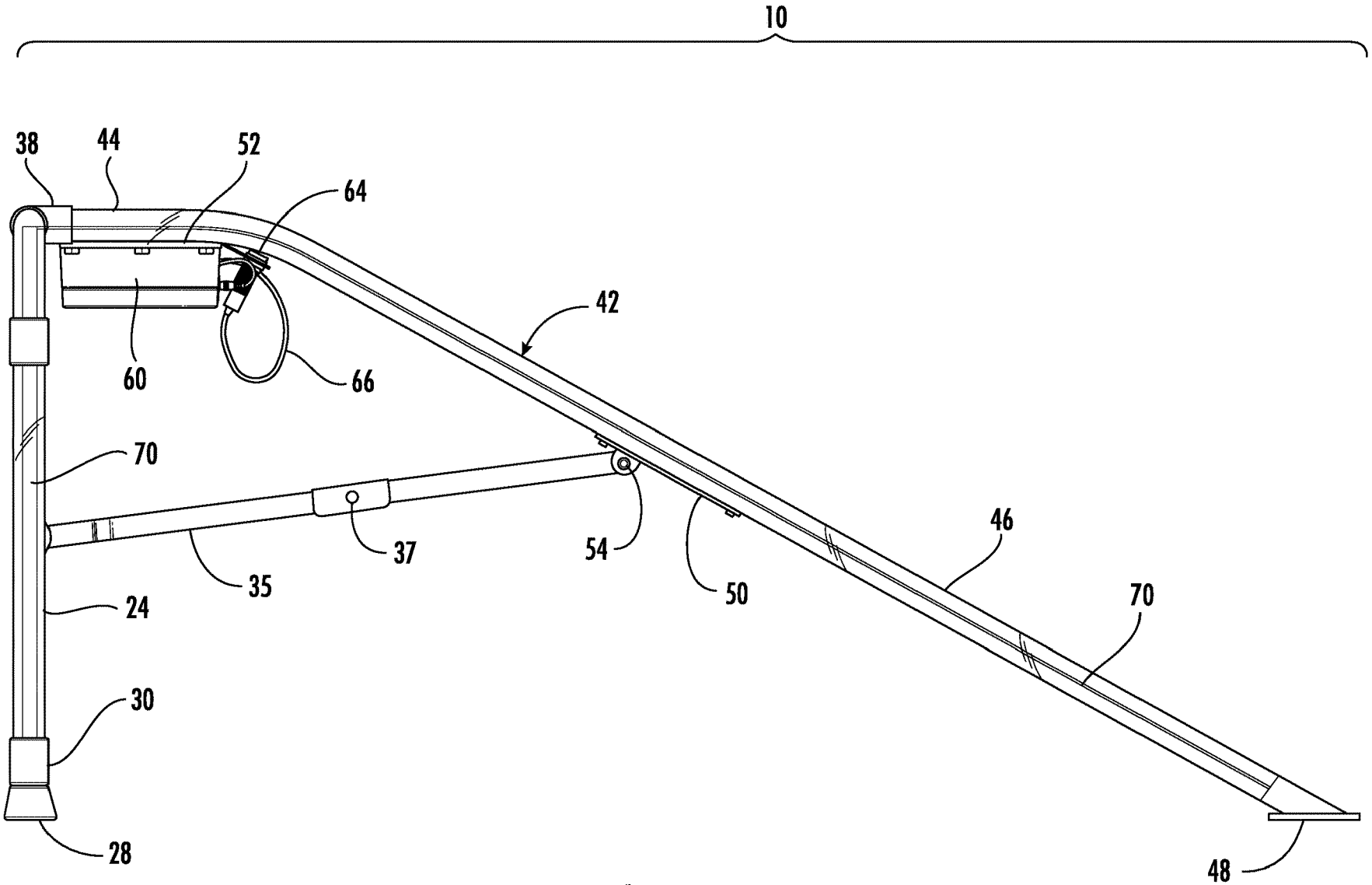
FIG. 4 is a side elevation view of the bowling ball ramp of FIG. 1 shown in the use configuration.

FIG. 4 is a side elevation showing the bowling ball ramp 10 in the use configuration. In particular, the stand assembly 20 is fully extended relative to the ramp assembly 40 such that the legs 24 of the stand 22 extend vertically downward from the horizontal ball supports 44 of the ramp arms 42 at an angle of substantially 90 degrees. In this use configuration, a linkage 35 extends in a substantially linear and unhinged manner between the cross member bracket 36 of the stand assembly 20 and a crossbar bracket 54 provided on the rear of the medial crossbar 50 of the ramp assembly 40 such that a hinge 37 of the linkage 35 is in a locked position.

Figure 5:
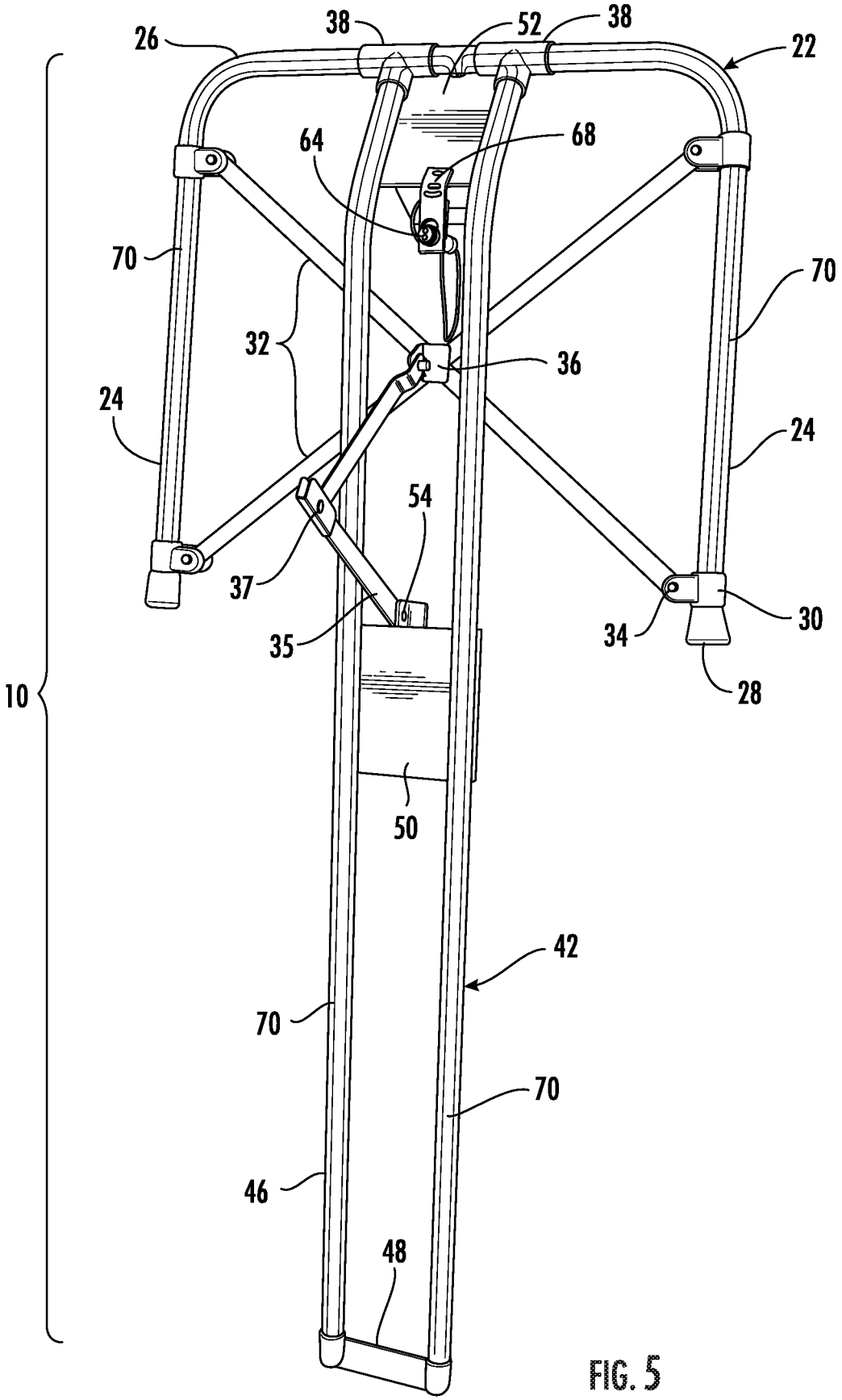
FIG. 5 is a rear plan view showing the bowling ball ramp of FIG. 1 in a partially collapsed configuration.
Figure 6:
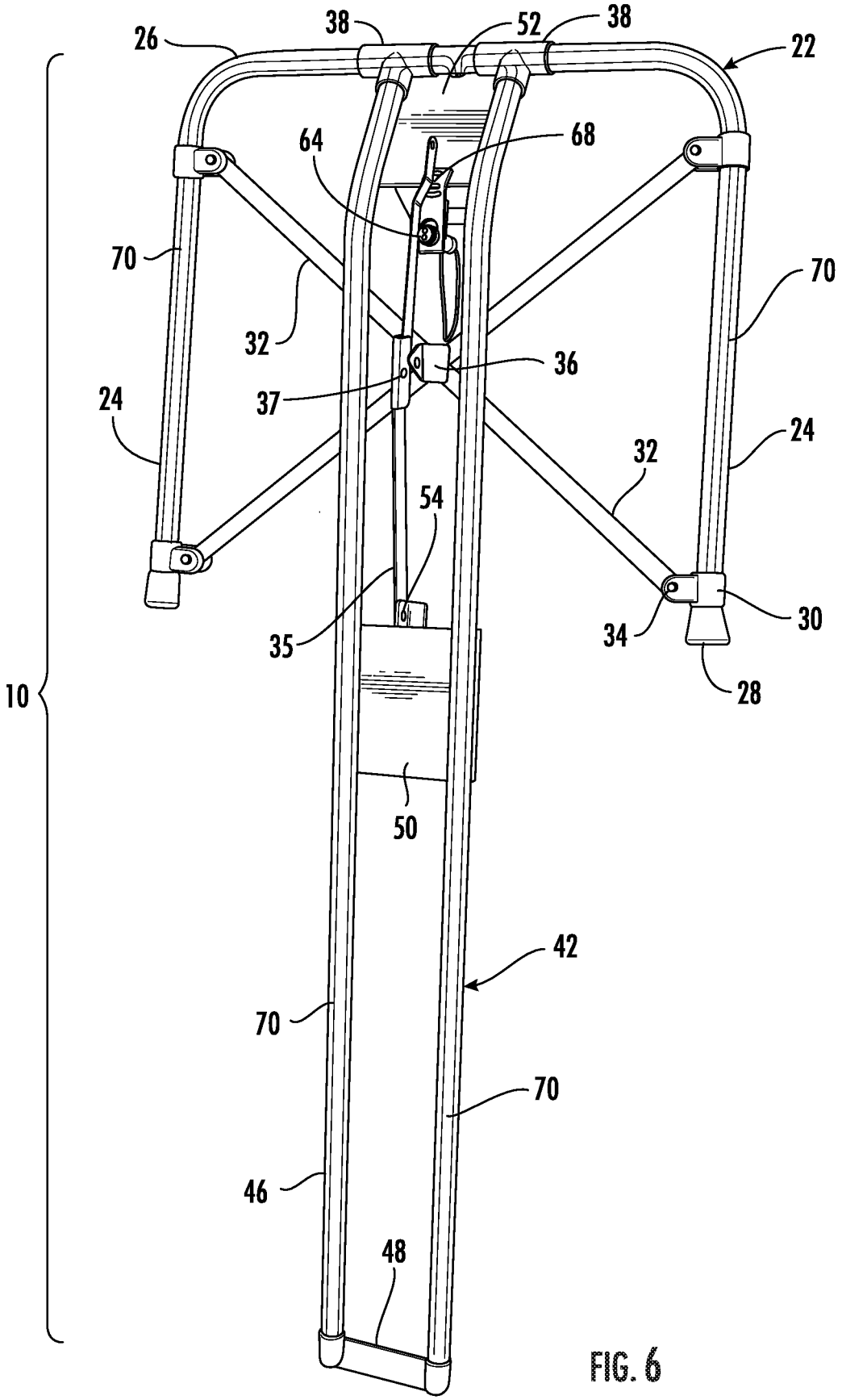
FIG. 6 is a rear plan view showing the bowling ball ramp of FIG. 1 in a fully collapsed configuration for transportation and storage.

FIG. 5 illustrates the bowling ball ramp 10 in a partially collapsed configuration wherein the hinge 37 is in an unlocked position. In the partially collapsed configuration, the linkage 35 extends in an angled and hinged manner between the cross member bracket 36 and the crossbar bracket 54 and the stand assembly 20 is rotated partially inward in the direction of the ramp assembly 40. Furthermore, the linkage 35 is detachable and can be removed from the cross member bracket 36. FIG. 6 illustrates the bowling ball ramp 10 in a fully collapsed configuration for compact transportation and storage. In the fully collapsed configuration, the linkage 35 is detached and removed from the cross member bracket 36 and the stand assembly 20 is rotated fully inward such that the stand 22 of the stand assembly 20 defines a plane that is generally parallel to the ramp arms 42 of the ramp assembly 40.

Figure 7:
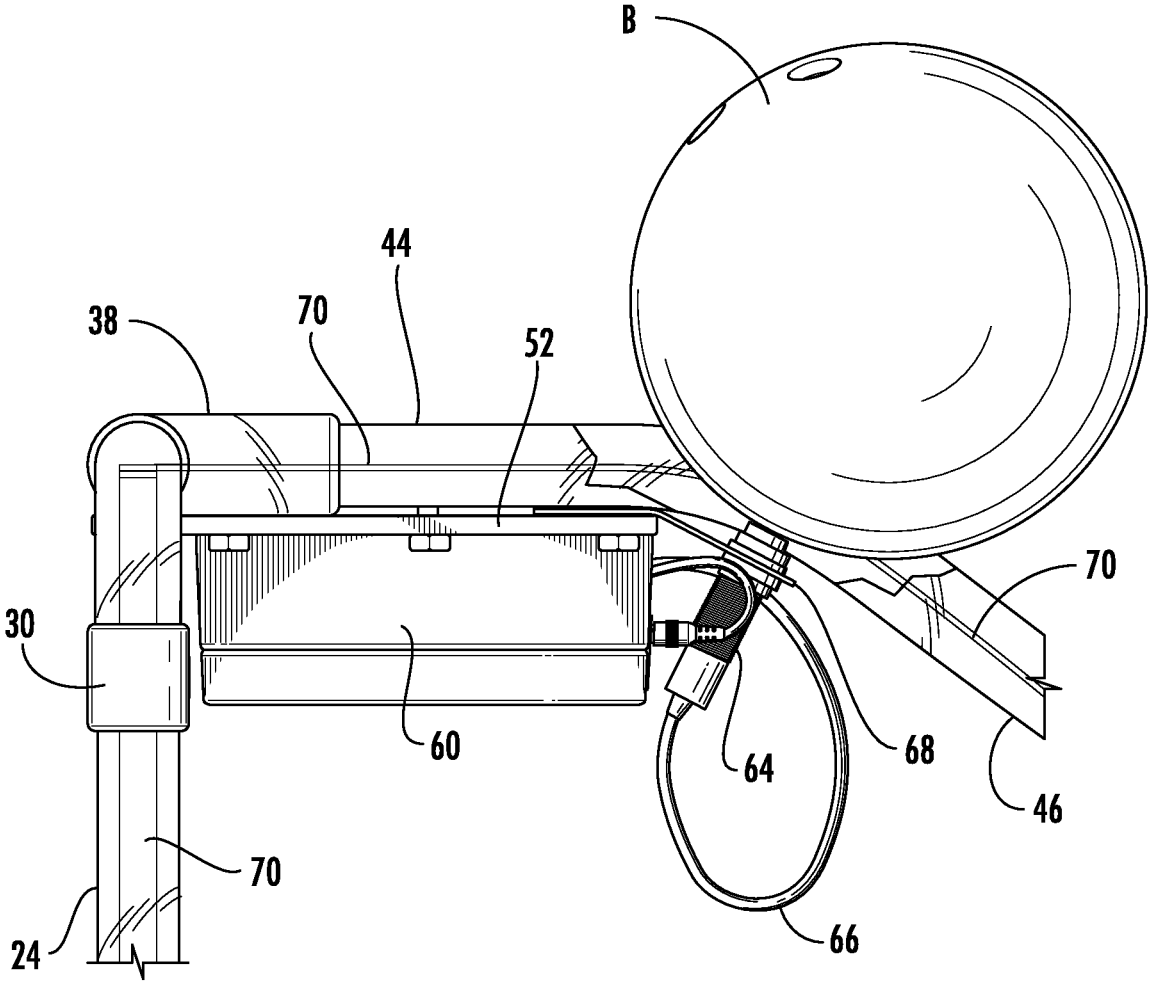
FIG. 7 is a partial side elevation view illustrating a bowling ball and the electronics assembly of the bowling ball ramp of FIG. 1 operating to produce illumination and/or sound.

FIG. 7 is a partial side elevation view of the bowling ball ramp 10 illustrating a bowling ball, indicated generally by reference character B, and the electronics assembly 60 operating to produce embedded lighting and/or sound to enhance the enjoyment of a bowling experience for a child or handicapped individual. The child or handicapped individual places the bowling ball B between the horizontal ball supports 44 of the ramp arms 42 and aims the distal ends of the angled ball supports 46 of the ramp arms 42 such that the bowling ball B can be launched from the bowling ball ramp 10 onto the surface of the bowling lane in a desired direction towards the bowling pins. The bowling ball B is then launched (i.e., pushed or rolled) from the horizontal ball supports 44 onto the angled balls supports 46 such that the bowling ball B passes over the detection sensor 64. The detection sensor 64 detects the presence or the passing of the bowling ball B and the microprocessor of the electronics 60 activates the light emitter circuit to cause the LEDs 72 of the embedded lighting 70 to be illuminated in a predetermined manner, for example, flashing or running in sequence. Optionally, the microprocessor of the electronics 60 may also activate the sound emitter circuit to cause the audio speaker 62 to produce a predetermined audible sound. The embedded lighting 70 and/or the audio speaker 62 may continue to be activated for a predetermined period of time, for example, the time it typically takes for the bowling ball B to reach the bowling pins at the end of the bowling lane.

Regardless of the foregoing detailed description of exemplary embodiments of the invention, the optimum structure of the invented device, and the manner of use, operation and steps of the invented method, as well as reasonable equivalents thereof, are deemed to be readily apparent and understood by those skilled in the art. Accordingly, equivalent relationships to those shown in the accompanying drawing figures and described in the written description are intended to be encompassed by the present invention and the ordinary and customary meaning of the appended claims, the foregoing being considered as illustrative only of the general concept and principles of the invention. Furthermore, since numerous modifications and changes will readily occur to those skilled in the art, the exemplary embodiments disclosed are not intended to limit the invention to the specific configuration, construction, materials, manner of use and operation shown and described herein. Instead, all obvious modifications and reasonably foreseeable equivalents thereof should be construed as falling within the scope of the inventions as defined by the broadest reasonable construction and interpretation of the appended claims in view of the accompanying written description and drawing figures.

That which is claimed is:

1. A bowling ball ramp comprising:

a stand assembly comprising a generally U-shaped stand defined by a pair of legs each having a lower end and an upper end with the upper ends of the pair of legs being interconnected by a crossbar and at least one cross member that extends between the lower end of one of the pair of legs and the upper end of the other of the pair of legs;

a ramp assembly rotatably coupled to the stand assembly and supported by the stand, the ramp assembly comprising a ramp defined by a pair of ramp arms each having an upper end rotatably attached to the crossbar of the stand, the ramp arms comprising a pair of horizontally extending ball supports extending from the crossbar of the stand and a pair of angularly extending ball supports extending from the horizontally extending ball supports, the ramp further comprising at least one medial crossbar disposed on the pair of angularly extending ball supports and a linkage extending between the cross member of the stand and the medial crossbar of the ramp, the linkage having a hinge operable for extending the ramp assembly relative to the stand assembly in a locked position and for collapsing the ramp assembly relative to the stand assembly in an unlocked position; and lighting disposed on at least one of the stand assembly and the ramp assembly and operable for illuminating at least one of the stand assembly and the ramp assembly in response to a detection sensor detecting a bowling ball on the ramp assembly.

2. The bowling ball ramp according to claim 1, further comprising electronics, and wherein the detection sensor is operably coupled with the electronics for detecting the bowling ball, and wherein the electronics activate the lighting in response to the detection sensor detecting the bowling ball.

3. The bowling ball ramp according to claim 2, further comprising an audio speaker operably coupled with the electronics for producing an audible sound, and wherein the electronics activate the audio speaker to produce the audible sound in response to the detection sensor detecting the bowling ball.

4. The bowling ball ramp according to claim 1, wherein the lighting is embedded within the at least one of the stand assembly and the ramp assembly.

5. The bowling ball ramp according to claim 4, wherein the lighting illuminates the at least one of the stand assembly and the ramp assembly when a bowling ball is detected on the ramp assembly.

6. The bowling ball ramp according to claim 1, wherein the at least one of the stand assembly and the ramp assembly is made of a substantially transparent material.

7. The bowling ball ramp according to claim 1, wherein the lighting comprises a plurality of light-emitting-diodes (LEDs).

8. The bowling ball ramp according to claim 1, further comprising an audio speaker operable for producing an audible sound.

9. The bowling ball ramp according to claim 1, wherein the at least one of the stand assembly and the ramp assembly are made of a substantially transparent, generally hollow, tubular material, and wherein the lighting is embedded within the at least one of the stand assembly and the ramp assembly.

10. A method for providing a bowling ball ramp with illumination, comprising:

providing a stand assembly comprising a generally U-shaped stand defined by a pair of legs each having a lower end and an upper end with the upper ends of the pair of legs being interconnected by a crossbar and at least one cross member that extends between the lower end of one of the pair of legs and the upper end of the other of the pair of legs;

providing a ramp assembly rotatably coupled to the stand assembly and supported by the stand, the ramp assembly comprising a ramp defined by a pair of ramp arms each having an upper end rotatably attached to the crossbar of the stand, the ramp arms comprising a pair of horizontally extending ball supports extending from the crossbar of the stand and a pair of angularly extending ball supports extending from the horizontally extending ball supports, the ramp further comprising at least one medial crossbar disposed on the pair of angularly extending ball supports and a linkage extending between the cross member of the stand and the medial crossbar of the ramp, the linkage having a hinge operable for extending the ramp assembly relative to the stand assembly in a locked position and for collapsing the ramp assembly relative to the stand assembly in an unlocked position;

providing lighting on at least one of the stand assembly and the ramp assembly;

providing a detection sensor operably coupled to the lighting; and illuminating the at least one of the stand assembly and the ramp assembly in response to the detection sensor detecting a bowling ball on the ramp assembly.

11. The method of claim 10, further comprising:

positioning a bowling ball on the horizontally extending ball supports of the ramp arms of the ramp assembly;

detecting the bowling ball on the ramp assembly using the detection sensor; and activating the lighting to illuminate the at least one of the stand assembly and the ramp assembly in response to the detection sensor detecting the bowling ball on the ramp assembly.

12. The method according to claim 11, further comprising:

providing an audio speaker operable for producing an audible sound; and activating the audio speaker to produce the audible sound in response to the detection sensor detecting the bowling ball on the ramp assembly.

13. The method according to claim 10, wherein the at least one of the stand assembly and the ramp assembly is made of a substantially transparent material, and wherein the lighting is embedded within the at least one of the stand assembly and the ramp assembly.

* * * * *